US006028261A

United States Patent [19]

Johnson

[11] Patent Number: 6,028,261

[45] Date of Patent: Feb. 22, 2000

[54] DRUM STICK WEIGHTS

[76] Inventor: Peter M. Johnson, 21816 Providencia St., Woodland Hills, Calif. 91364

[21] Appl. No.: 09/162,615

[22] Filed: Sep. 29, 1998

Related U.S. Application Data

[60] Provisional application No. 60/060,210, Sep. 30, 1997.

[51] Int. Cl.[7] ..... G10D 13/02

[52] U.S. Cl. ..... 84/422.4

[58] Field of Search ..... 84/422.4

[56] References Cited

U.S. PATENT DOCUMENTS

| | | | |
|---|---|---|---|
| 2,521,336 | 9/1950 | Bramson . | |
| 3,592,097 | 7/1971 | Friede | 84/422.4 X |
| 4,202,241 | 5/1980 | Lucas | 84/422.4 |
| 5,044,250 | 9/1991 | Beyer | 84/422.4 |
| 5,263,395 | 11/1993 | Phillips | 84/422.4 |
| 5,265,514 | 11/1993 | Schertz | 84/422.4 |
| 5,581,031 | 12/1996 | Blankenship | 84/422.4 X |

*Primary Examiner*—Stanley J. Witkowski
*Attorney, Agent, or Firm*—Zarley, McKee, Thomte, Voorhees & Sease

[57] ABSTRACT

Drum stick weights are described that include weighted material that may be releasably attached to drum sticks. The weighted material may optionally be placed in separate means used to secure the weighted material to the drum sticks. The drum stick weights are compact and easy to manufacture. The drum stick weights can be used to increase drummers' drum playing skills and flexibility.

17 Claims, 2 Drawing Sheets

DRUM STICK WEIGHTS

CROSS-REFERENCE TO A RELATED APPLICATION

This application is a continuation-in-part of copending, commonly assigned provisional application Ser. No. 60/060,210, filed Sep. 30, 1997, the disclosure of which is hereby incorporated by reference.

BACKGROUND OF THE INVENTION

A common routine for drummers during practice sessions and when warming up on their drums is to play with two drum sticks in each hand. The added weight allows drummers to strengthen their wrist muscles. When the weights are removed from the sticks, the drummer notices an increase in control, speed and agility while playing. This practice has several drawbacks, however.

First, extra drum sticks are bulky and can be difficult for the drummer to maneuver and control. The extra sticks are also inconvenient for the drummer to carry. Further, the added drum sticks are awkward and bulky to manipulate and can easily slip around in the drummer's hands while practicing. Moreover, additional drum sticks distort the true shape and feel of the drum sticks in the musicians' hands.

There is therefore a need in the art for a more convenient and efficient means of improving drum playing skills which allows drummers to strengthen their wrist muscles without distorting the normal size and feel of the drum sticks.

Accordingly, it is a primary objective of the present invention to provide a method and means of improving drum playing skills which eliminates the need for the drummer to practice using two sticks in each hand.

It is another objective of the present invention to provide a method and means of improving drum playing skills which is convenient for the drummer to practice.

It is a further objective of the present invention to provide a method and means of improving drum playing skills which does not distort the normal feel of the drum sticks.

It is yet a further objective of the present invention to provide a method and means of improving drum playing skills which is not bulky or awkward to use.

It is another objective of the present invention to provide a method and means of improving drum playing skills which is economical.

The method and means of accomplishing each of the above objectives as well as others will become apparent from the detailed description of the invention which follows hereafter.

SUMMARY OF THE INVENTION

The invention describes a method and means for improving drum playing skills which also strengthens the drummer's wrist muscles. The method includes the application of at least one weight to one or both drum sticks during warm-up or practice. The weights are small and easy to carry and are not bulky when placed on the drum sticks. Further, the weights conform to the shape of the drumstick, and therefore do not distort the true shape and feel of the drum sticks in the musicians' hands.

DETAILED DESCRIPTION OF THE PREFERRED EMBODIMENT

Figure 3:
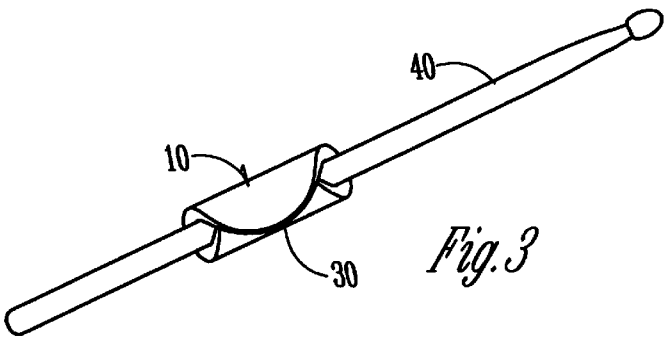
FIG. 3 is an elevational view of a preferred embodiment of a drum stick weight in accordance with the present invention as shown on a drum stick.

The drum stick weights of the present invention are generally designated in the drawings by the reference numeral 10. Each weight 10 generally includes weighted material 20 and may also have a means of attaching 30 the weighted material 20 to the drum stick 40.

The weighted material 20 used in the drum stick weight 10 can be manufactured from a variety of materials that are conventionally used in making weights for other purposes including metals such as lead, iron, graphite, and steel and various other materials including stone and wood. These materials can also be used in combination. The only requirement for the weighted material 20 is that it be sufficiently heavy so that it does not require large quantities of the material to add the requisite amount of weight to the drum sticks 40.

The weighted material 20 should generally be included in an amount that adds from about one to seven ounces of total weight to the drum stick 40. The preferred weight is about two ounces. More or less weight can be added or subtracted from the drum stick weight 10 depending on the personal needs and preferences of the individual drummer. However, if too much weight is added, it may be too difficult for the drummer to maneuver the drum sticks 40. Conversely, if insufficient weight is added, the drummer will not derive a benefit from using the drum stick weights 10.

Figure 2:
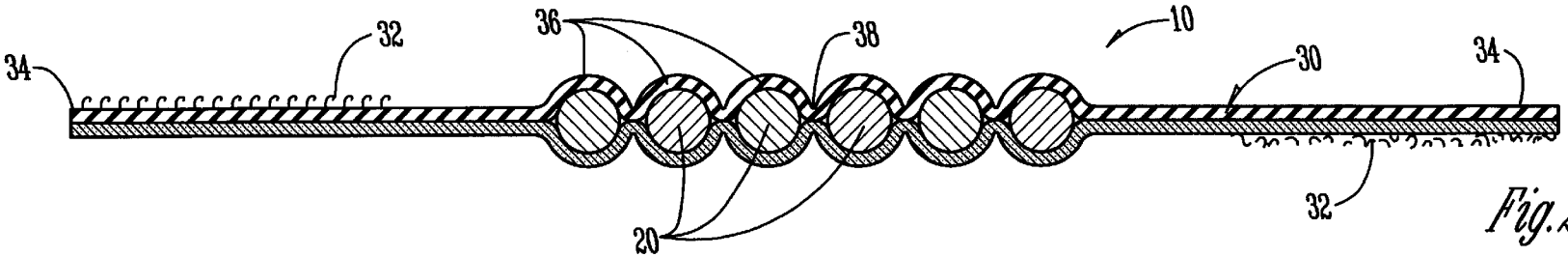
FIG. 2 is a sectional view of a preferred embodiment of a drum stick weight in accordance with the present invention taken along lines 2—2 of FIG. 1.

The drum stick weight 10 may include a means of attaching 30 the weighted material 20 to the drum stick 40. The only requirement for the means for attaching 30 is that it somewhat conform to the shape of the drum stick 40 so that it is not overly bulky and/or distort the feeling of the drum stick 40 in the drummer's hand. A preferred means of attaching the weighted material 20 to the drum stick 40 is through the use of a wrap-around attachment 30 which evenly distributes the weight around the drum stick 40. Such wrap-around means of attachment 30 is shown in a preferred embodiment of the drum stick weights 10 in FIGS. 1–3. The attachment means 30 can generally be made of any type of material that is sturdy enough to hold the weighted material 20. Such materials include cotton, rayon, leather, burlap, nylon, plastic etc. The attachment means 30 can be molded in one piece or made of two pieces of separate material which can be used to "sandwich" the weights 20.

The attachment means 30 may be formed in a "hoop" so that it can simply be slid onto the drum stick 40. The attachment means 30 can also be made to include at least one fastener 32 on at least one end 34 to enclose the drum stick weight 10 around the drum stick 40. The fastener 32 can be any type of conventional fastener, such as Velcro, snaps, buttons, tape, glue etc. Velcro is preferred since it allows the user to easily adjust the tightness of the fit of the weight 10 on the drum stick 40 and also compensates for drum sticks 40 of different widths. The attachment means 30 can also be made of a flexible or accordion pleated material that can be stretched to snugly fit around the drum stick 40.

The weighted material 20 itself can also be curved so that it conforms to the shape of the drum stick 40. Thus, the weighted material 20 can then be slipped directly onto the drum stick 40 without the need for a separate attachment means 30. Furthermore, a liner can be placed along the inside part of the curved weighted material 30 which contacts the drum stick 40, so that the weighted material 30 better grips the drum stick 40 to prevent the drum stick weight 10 from sliding up and down the stick 40 or completely slipping off. Such liners can be made of plastic, rubber, or other material that is capable of creating a frictional surface between the weighted material 20 and the drum stick 40.

Figure 1:
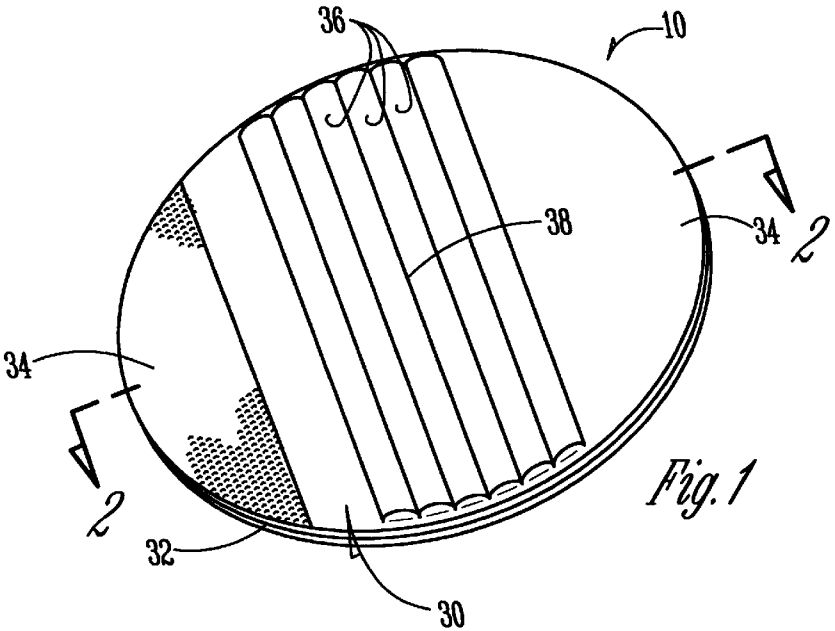
FIG. 1 is a perspective view of a preferred embodiment of a drum stick weight in accordance with the present invention.

FIG. 1 shows a preferred embodiment of the drum stick weights 10 wherein the weighted materials 20 are elongated and placed in pockets 36 in the center portion 38 of the attachment means 30. The pockets 36 serve a number of functions including preventing the weighted material 20 from falling out of the attachment means 30, protecting the drummer's hands and drums from impact with the weighted material 20, and likewise protecting the weighted material 20 from damage. The pockets 36 also position the weighted material 20 so that it is evenly distributed around the circumference of the drum stick 40.

The pockets 36 may optionally have openings so that one or more weighted material 20 may be removed or added to the drum stick weight 10 so that the overall weight of the drum stick 40 may be easily varied.

The drum stick weight 10 shown in FIG. 1 is generally oval in shape. However, it can also be rectangular, round, square, or any other shape capable of wrapping around the drum stick 40. Oval is preferred. Each end 34 of the attachment means 30 is preferably reinforced with a heavy material, such as leather. Here, the attachment means 30 is shown with Velcro fasteners 32 on each end 34.

While the drum stick weight 10 does not have to be of any particular length or width, as a practical matter it should have a horizontal length of between about 3 to 8 inches and a vertical width of between about 1 to 4 inches. If the length is more than 8 inches, the drummer's hands may contact the weight 10, thereby distorting the feeling of the drum sticks 40. If the drum stick weight 10 is wider than 4 inches, it may add too much bulk to the drum stick 40.

Figure 4:
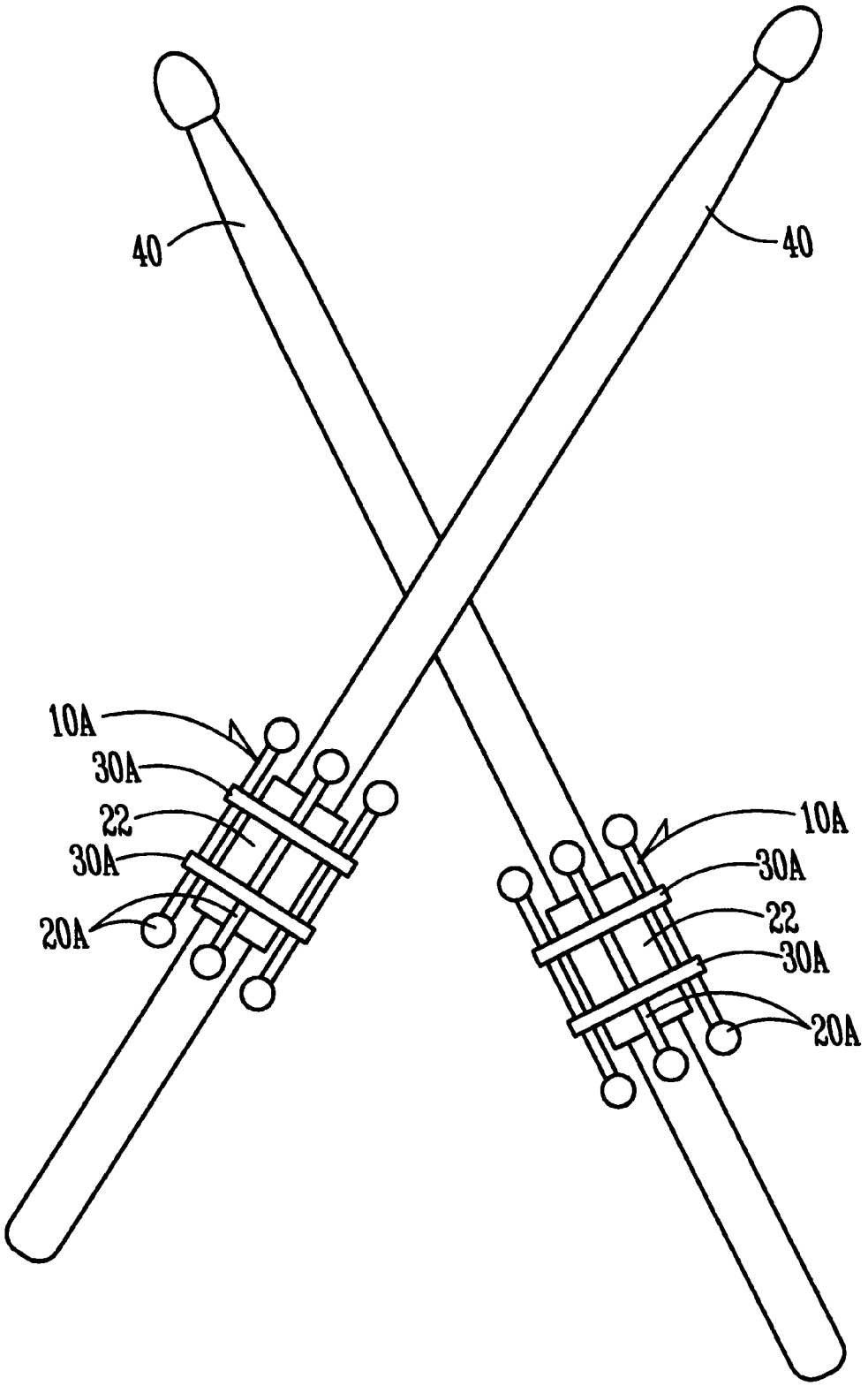
FIG. 4 is an elevational view of an alternative embodiment of drum stick weights in accordance with the present invention as shown on a pair of drum sticks.

Another embodiment of the drum stick weights 10 is shown in FIG. 4 and is designated as 10*a*. Here, at least one barbell shaped weight 20*a* is secured to the drum sticks 40 using elastic bands 30*a*. The weighted material 20*a* can also be similarly secured using non-elastic fasteners, such as string. There may also be a pad 22 positioned between the weighted material 20*a* and the drum stick 40 to prevent the weighted material 20*a* from sliding or scratching the drum stick 40.

In practice, when the drummer begins warming up, he/she takes one or more drum stick weights 10 and slides it on or wraps it around the drum stick(s) 40. The weight 10 is placed on the drum stick 40 so that it preferably avoids contacting the drummer's hand while playing. While the drummer is playing, the increased weight increases the amount of strength necessary for the drummer to navigate the drum sticks 40 around the drums and provides increased resistance. Once the practice session or warm-up is over, the drum stick weights 10 are removed from the drum sticks 40. Once removed, the drummer will immediately notice that the suddenly lighter drum sticks 40 are much easier to maneuver while playing. With prolonged use, the drummer will notice increased muscle strength in the wrists and arms, which will contribute to an increased ability to play. Drummers can easily transport the compact drum stick weights 10 to and from practice sessions and gigs by slipping them in their pockets, drum stick holders, or drum cases.

The invention has been shown and described above in connection with the preferred embodiment, and it is understood that many modifications, substitutions, and additions may be made which are within the intended broad scope of the invention. From the foregoing, it can be seen that the present invention accomplishes at least all of the stated objectives.

I claim:

1. A weighted drum stick comprising:

a drum stick; and a weighted material removably attached on the drum stick whereby the weighted material is placed on the drum stick such that it does not contact the hand of the drummer, and further providing that the weighted material does not affect the sound made when the drum stick contacts the drum.

2. A drum stick weight according to claim 1 wherein the weighted material is made of a substance selected from the group consisting of metal, wood, and stone.

3. A drum stick weight according to claims 1 wherein the weighted material is curved to conform to the shape of the drum stick.

4. A drum stick weight according to claim 3 wherein the weighted material encircles the drum stick.

5. A drum stick weight according to claim 3 further including a padded material placed between the weighted material and the drum stick.

6. A drum stick weight according to claim 1 further including a means of attaching the weighted material to the drum stick.

7. A drum stick weight according to claim 6 wherein the means are selected from the group consisting of rubber bands, elastic, and string.

8. A drum stick weight according to claim 6 wherein the means includes pockets, said weighted material being placed within said pockets.

9. A drum stick weight according to claim 8 wherein the pockets and weighted material are elongated.

10. A drum stick weight according to claim 6 wherein the means of attaching the weighted material has two ends, each end having a fastener.

11. A drum stick weight according to claim 10 wherein the fastener is selected from the group consisting of snaps, Velcro, and buttons.

12. A drum stick weight according to claim 1 wherein the weighted material is barbell-shaped.

13. A drum stick weight according to claim 1 wherein the weighted material is disbursed evenly around the drum stick.

14. A drum stick weight according to claim 1 wherein the weighted material weighs from about one to seven ounces.

15. A drum stick weight according to claim 6 wherein the means of attaching the weighted material is from about 3 to 8 inches in length and from about 1 to 4 inches in width.

16. A drum stick weight according to claim 6 wherein the means of attaching the weighted material is flexible or accordion pleated.

17. A weighted drum stick comprising:

a drum stick;

a weighted material; and a means of attaching the weighted material to the drum stick, the means including pockets whereby the weighted material is placed in the pockets;

and further providing that the weighted material is disbursed evenly around the drum stick.

* * * * *